US005803308A

United States Patent [19]

Rong

[11] Patent Number: 5,803,308

[45] Date of Patent: Sep. 8, 1998

[54] BURGLARPROOF DEVICE FOR LOTTERY TICKET DISPENSER

[76] Inventor: Chern-Bao Rong, P.O. Box 453, Taichung, Taiwan

[21] Appl. No.: 570,898

[22] Filed: Dec. 12, 1995

[51] Int. Cl.[6] ..... G07F 11/00

[52] U.S. Cl. ..... 221/7; 221/277; 221/255

[58] Field of Search ..... 221/7, 277, 255; 271/10.11

[56] References Cited

U.S. PATENT DOCUMENTS

| | | | |
|---|---|---|---|
| 1,919,238 | 7/1933 | McCarthy | 271/10.11 |
| 3,791,392 | 2/1974 | Hanson | 221/7 |
| 4,316,606 | 2/1982 | Buys | 271/10.11 |
| 4,443,006 | 4/1984 | Hasegawa | 271/10.11 |
| 4,717,043 | 1/1988 | Groover et al. | 221/7 |
| 5,238,143 | 8/1993 | Crighton | 221/7 |

FOREIGN PATENT DOCUMENTS

| | | | |
|---|---|---|---|
| 402178128A | 7/1990 | Japan | 271/10.11 |

*Primary Examiner*—H. Grant Skaggs
*Attorney, Agent, or Firm*—Harrison & Egbert

[57] ABSTRACT

A burglarproof lottery ticket dispenser includes a triggering element having a handle. The triggering element is mounted on a slide shaft such that the handle is capable of locating or actuating a drive shaft. The dispenser further includes a driven shaft on which a driven element and a pawl are mounted. The driven element is provided with a driven gear engageable with a rotation gear, and an inner ratchet wheel capable of cooperating with the pawl. An electronic eye for counting the dispensed lottery tickets is located on an opening which is located between the ticket guiding arcuate edge and the second stopping edge of the upper and the lower guide plates.

1 Claim, 9 Drawing Sheets

(A)

(B)

(A)

(B)

BURGLARPROOF DEVICE FOR LOTTERY TICKET DISPENSER

FIELD OF THE INVENTION

The present invention relates generally to a lottery ticket dispensing machine, and more particularly to a device for preventing the burglary of the lottery ticket dispensing machine.

BACKGROUND OF THE INVENTION

As shown in FIGS. 1 and 2, a prior art lottery ticket dispenser comprises a main body 10 in which a servomotor 11 is mounted. The servomotor 11 is intended to drive a longitudinal worm rod 12 engageable with a worm wheel 15 of a driving guide wheel 13 which is mounted on a horizontal drive shaft 14 located in the main body 10. The main body 10 further comprises an supper guide plate 16 and a lower guide plate 17, which are fastened with a face plate 18 having an opening 19. The upper and the lower guide plates 16 and 17 are provided respectively with slots 20 and are fastened pivotally with a horizontal rolling shaft 22 on which an auxiliary roller 21 is mounted. The auxiliary roller 21 is actuated by the driving guide wheel 13. A rotation gear 23 and a transmission gear 24 are mounted, respectively, on the drive shaft 14 and the horizontal rolling shaft 22. The drive shaft 14 is received in an axial hole 25 of the main body 10 such that both ends of the drive shaft 14 are fitted respectively into an L-shaped spring 27 located by a fastening projection 26. The drive shaft 14 moves forward to cause the rotation gear 23 to mesh with the transmission gear 24. The axial hole 25 enables the drive shaft 14 to be moved rearwards so as to cause the rotation gear 23 to disengage the driving guide wheel 13 in order to facilitate the maintenance of the lottery ticket dispenser or the replenishing of the lottery tickets 28. As the lottery tickets 28 are dispensed, they are counted by an electronic eye device 29.

As illustrated in FIG. 3, the prior art lottery ticket dispenser described above can be tampered with easily by means of a rigid thin object A. The object A is inserted from the lower edge of the guide Plate 17 at the opening 19 to the worm wheel 15 in order to disrupt the operation of the electronic eye device 29. In addition, it is difficult to bring about the disengagement of the rotation gear 23 with the transmission gear 24 to facilitate the maintenance of the lottery ticket dispenser of the prior art.

SUMMARY OF THE INVENTION

It is therefore the primary objective of the present invention to provide a lottery ticket dispensing machine, which can not be tampered with easily.

These and other objects and advantages of the present invention will become apparent from a reading of the attached specification and appended claims.

DETAILED DESCRIPTION OF THE INVENTION

Figure 1:
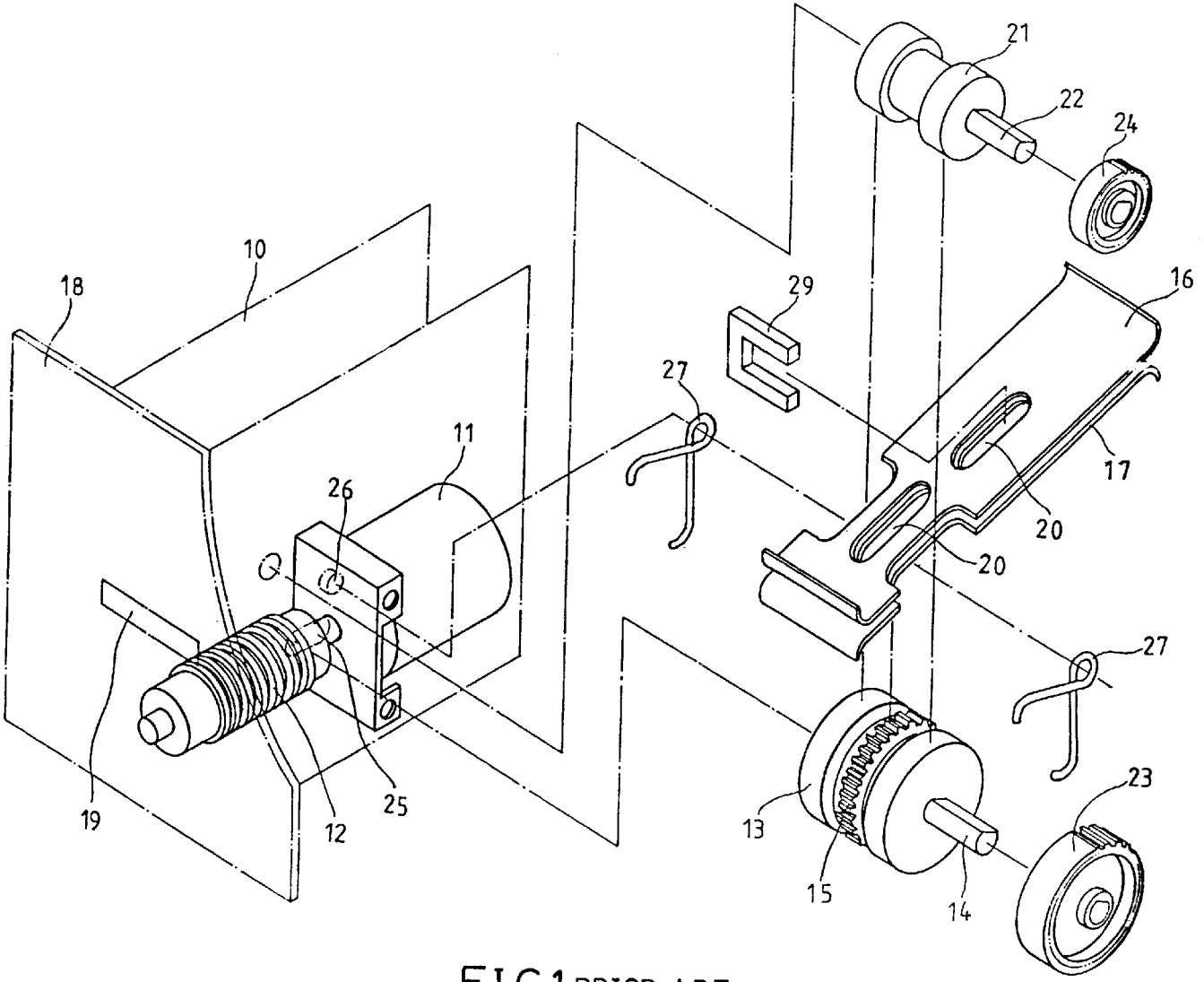
FIG.1 PRIOR ART
FIG. 1 shows an exploded view of a lottery ticket dispenser of the prior art.
Figure 2:
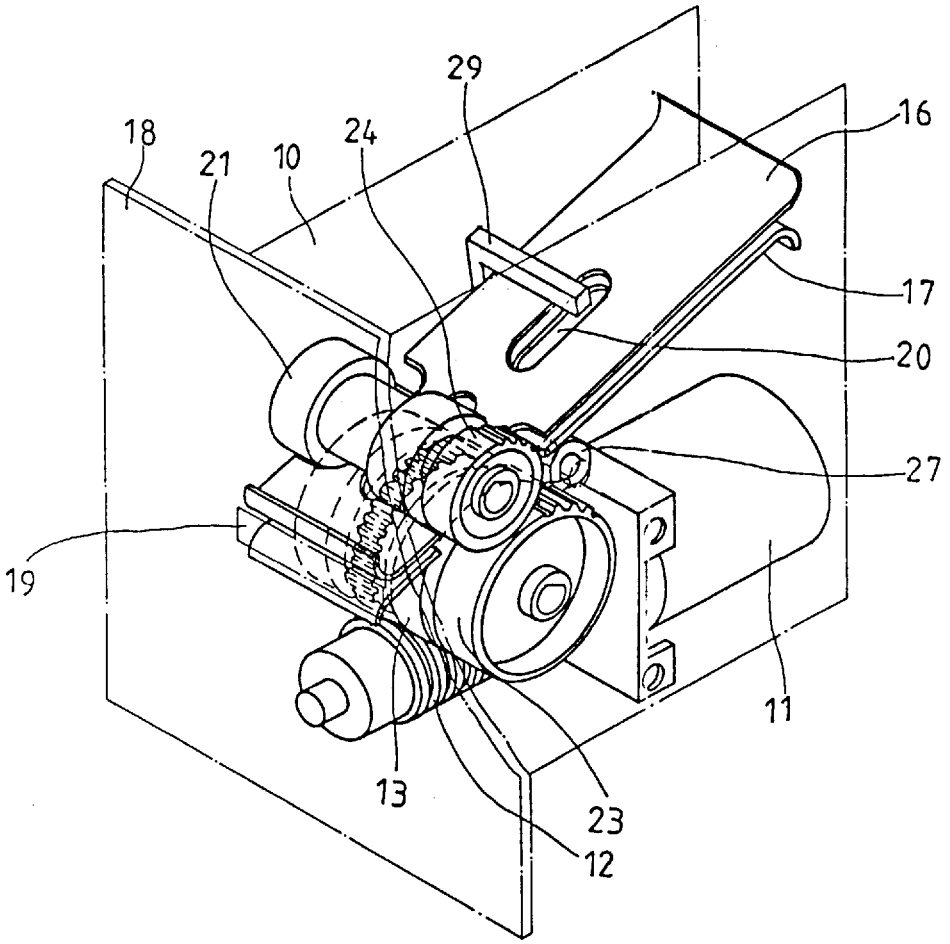
FIG.2 PRIOR ART
FIG. 2 shows a perspective view of the lottery ticket dispenser of the prior art in combination.
Figure 3:
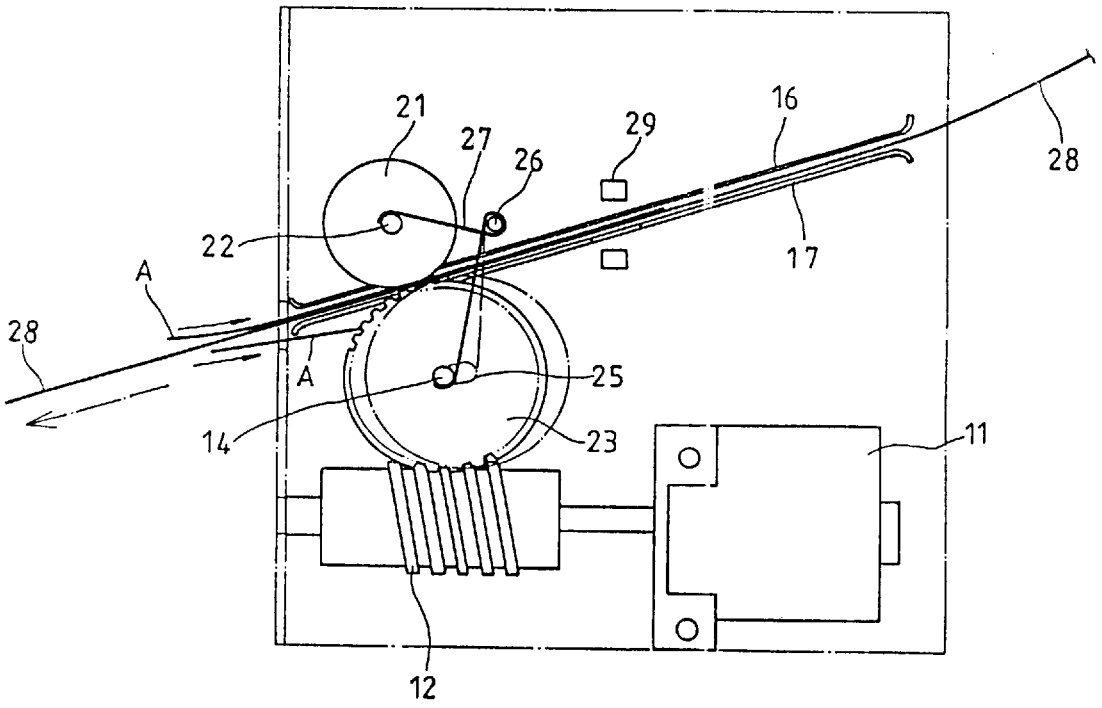
FIG.3 PRIOR ART
FIG. 3 shows a schematic view of the act of tampering with the prior art lottery ticket dispenser.
Figure 4:
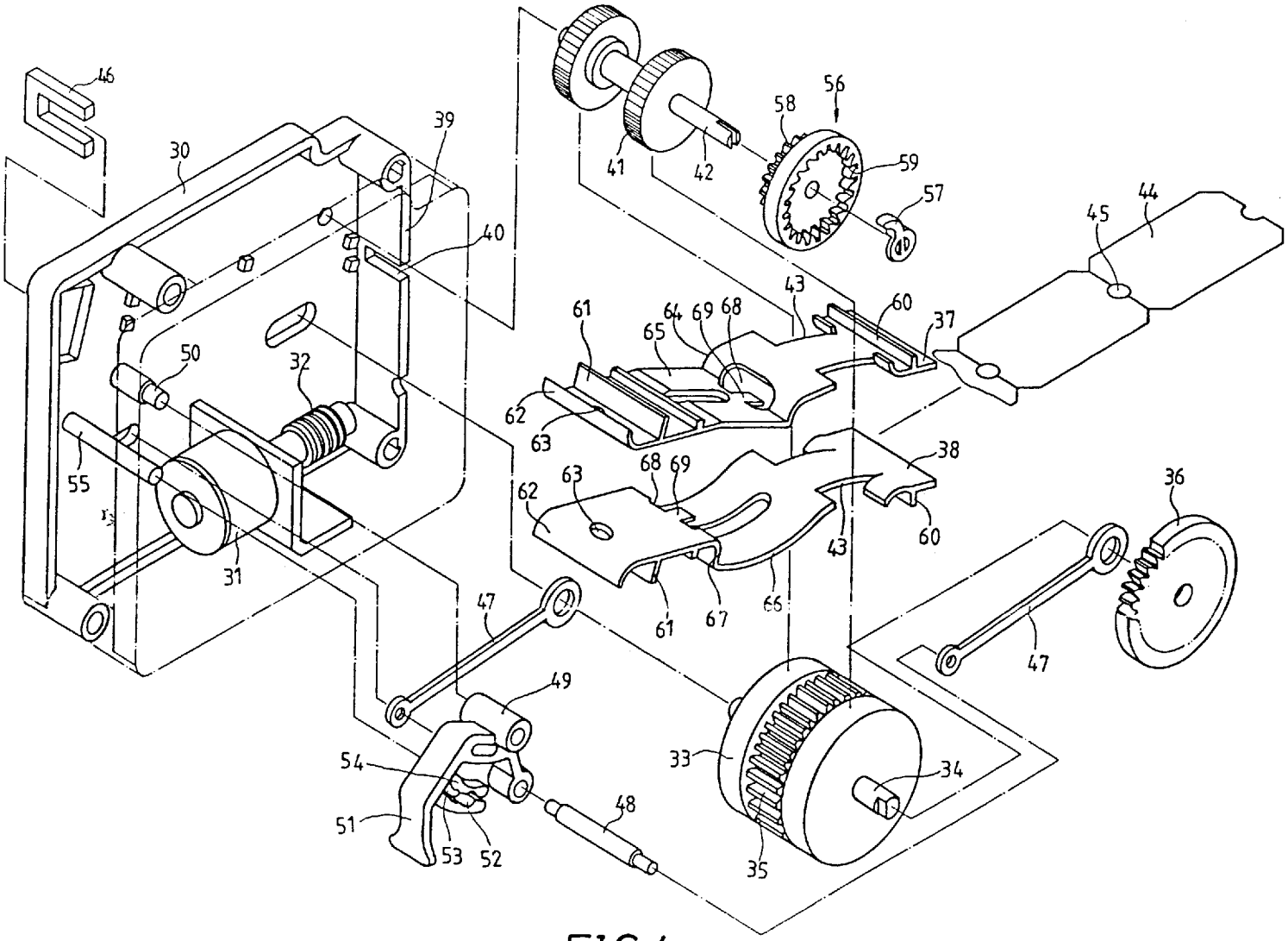
FIG. 4 shows an exploded view of a lottery ticket dispenser of the present invention.
Figure 5:
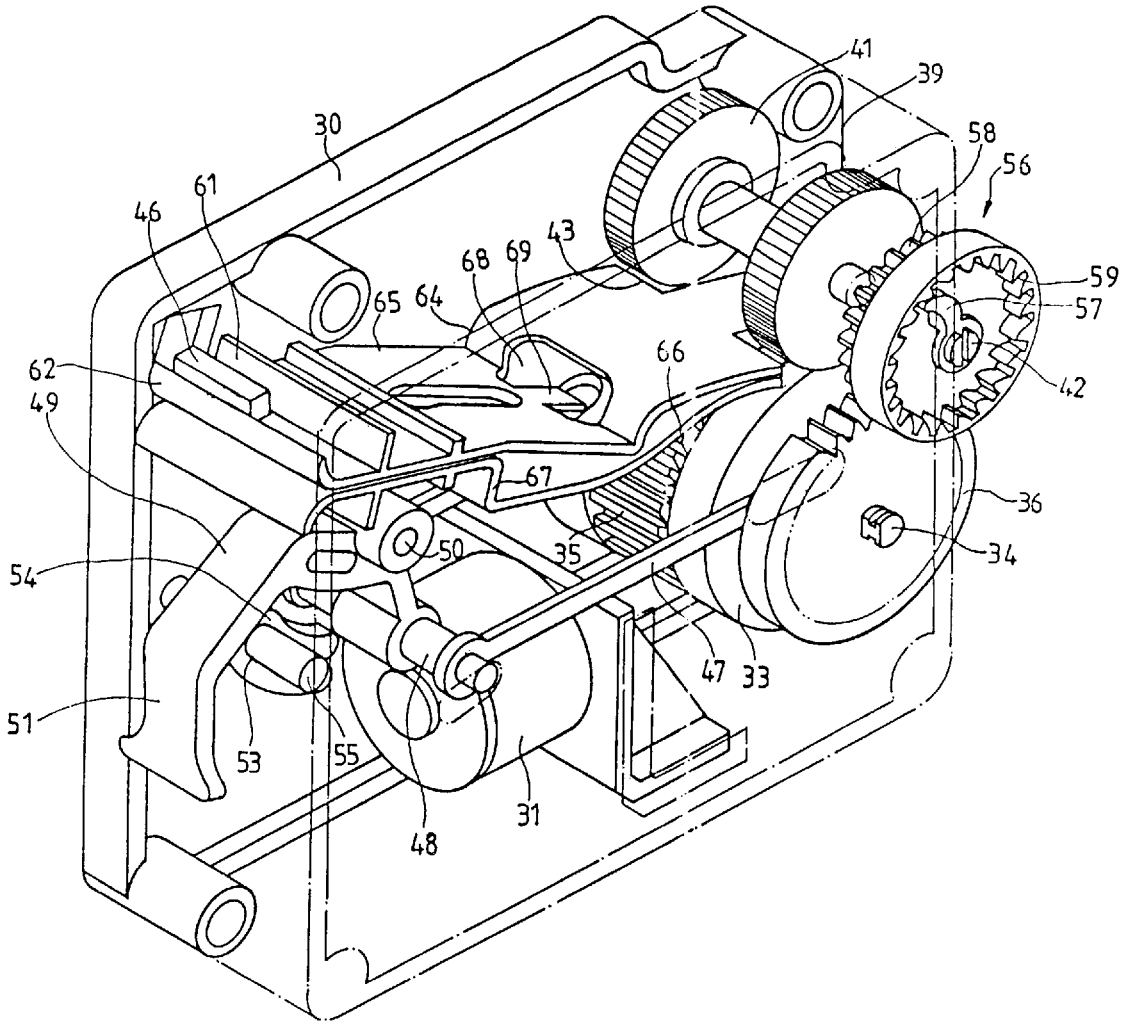
FIG. 5 shows a perspective view of the lottery ticket dispenser of the present invention in combination.
Figure 6:
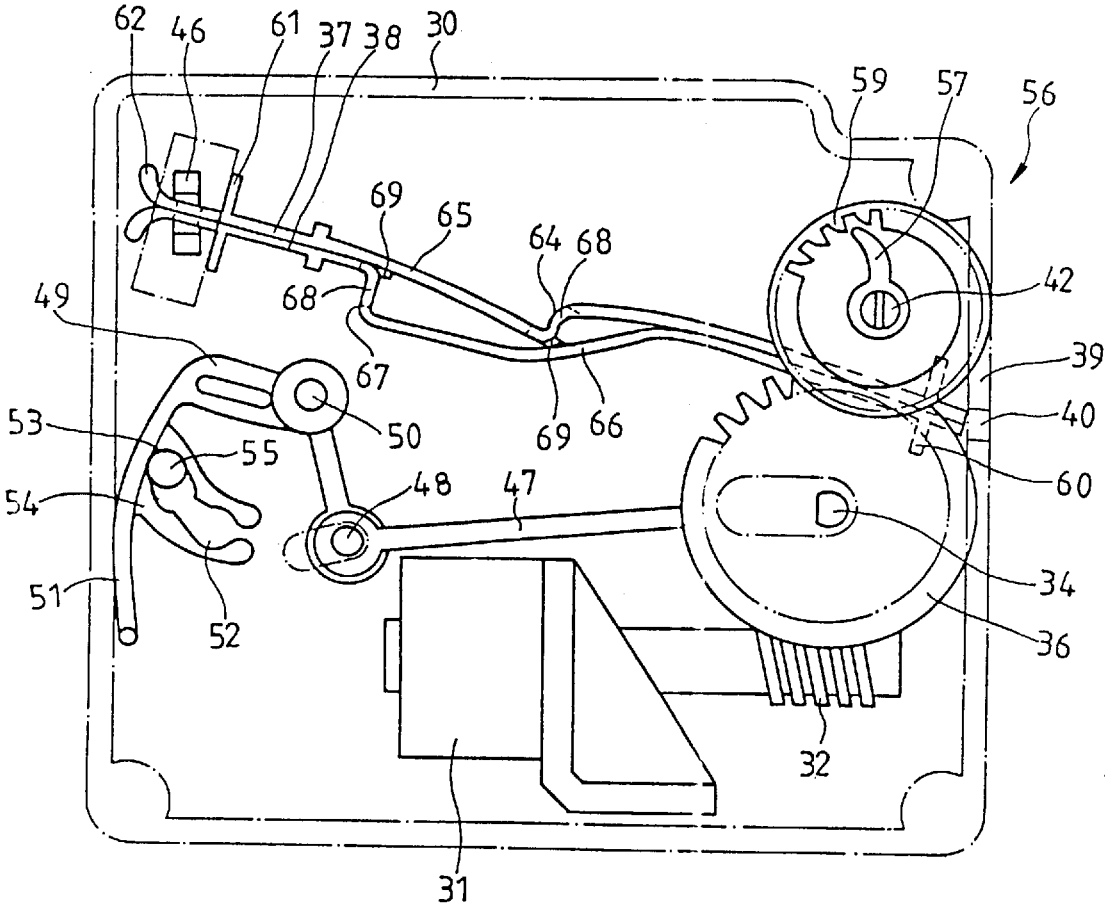
FIG. 6 shows a side view of the lottery ticket dispenser of the present invention.

As shown in FIGS. 4–6, the lottery ticket dispenser of the present invention comprises a main body 30 in which a servomotor 31 is mounted longitudinally. The servomotor 31 has a worm rod 32 serving as an output shaft of the servomotor 31. The main body 30 is provided therein with a drive shaft 34 on which a driving roller 33 is mounted. The driving roller 33 is provided at the midsegment thereof with a worm wheel 35 engageable with the worm rod 32. The drive shaft 34 is provided with a rotation gear 36. The main body 30 comprises an upper guide plate 37 and a lower guide Plate 38, which are fastened with the face plate 39. The main body 30 further comprises therein a driven shaft 42 on which an auxiliary roller 41 is mounted. The upper and the lower guide Plates 37 and 38 are provided with a plurality of slots 43. The auxiliary roller 33 is engaged with the driving roller 33. The lottery ticket 44 is first counted by an electronic eye device 46 before being sent out via the opening 40. The drive shaft 34 is fastened with a link rod 47 which is connected at one end thereof with a sliding shaft 48 which is linked with a triggering element 49. The triggering element 49 is fastened pivotally with a horizontal shaft 50 and is provided with a handle 51 having a clamping member 54 provided with locating edges 52 and 53. The triggering element 49 is located on a locating shaft 55 for locating or triggering the drive shaft 34. The driven shaft 42 is provided with a driven element 56 and a pawl 57. The driven element 56 is provided with a driven gear 58 engageable with the rotation gear 36, and with a ratchet wheel 59 capable of cooperating with the pawl 57. The upper and the lower guide plates 37 and 38 are provided respectively with a first stopping edge 60, a second stopping edge 61, and a ticket guiding arcuate edge 62. The electronic eye 46 is located at an opening 63 which is located between the ticket guiding arcuate edge 62 and the second stopping edge 61. The upper guide plate 37 is provided at the midsegment thereof with a front baffle 64 and a rear guide edge 65. The lower guide plate 38 is provided at the midsegment thereof with a front guide edge 66 and a rear baffle 67. The front and the rear baffles 64 and 67 are provided respectively with a guide slot 68 having a guide plate 69 extending therefrom to reach beyond the front edges of the front and the rear baffles 64 and 67.

Figure 7:
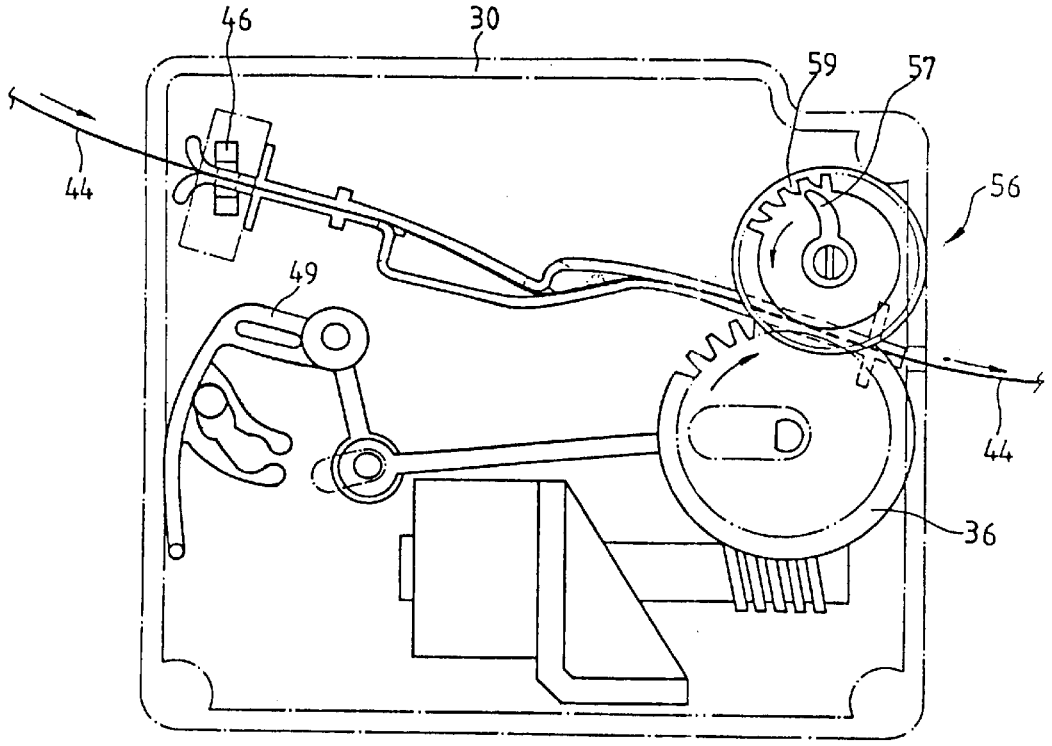
FIGS. 7A and 7B show schematic views of the invention and show, in partcular, how the present invention prevents tampering with the driven member.
Figure 7:
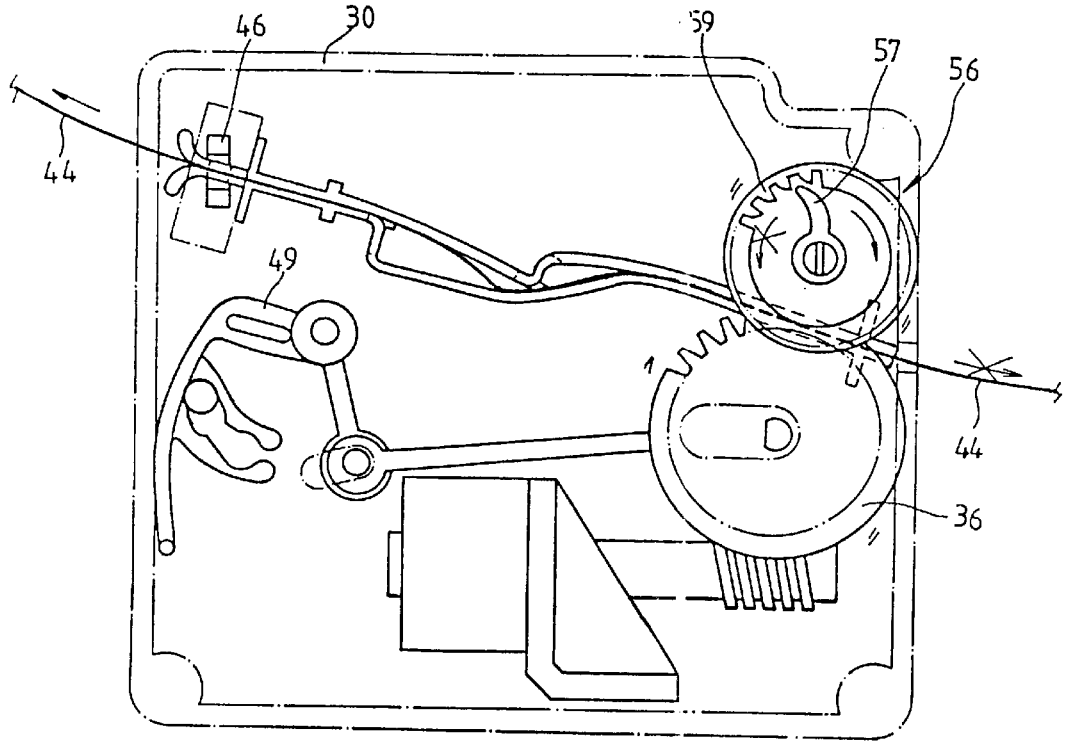

As shown in FIG. 7A, the driven element 56 of the present invention is fastened pivotally with the drive shaft 42 and is provided with the driven gear 58 engageable with the rotation gear 36. The driven element 56 of the present invention is further provided with an inner ratchet wheel 59 capable of cooperating with the pawl 57. In operation, the auxiliary roller 41 is engaged with the driving roller 33 to dispense the lottery tickets 44. In the meantime, the driven gear 58 and the inner ratchet wheel 59 of the driven element 56 are actuated by the rotation gear 36. The pawl 57 is also actuated to rotate along with the auxiliary roller 41 without engaging the inner ratchet wheel 59 of the driven element 56. As shown in FIG. 7B, when the operation of dispensing the lottery tickets 44 is interrupted, the driven element 56 is stopped in view of the fact that the worm rod 32 has a locating effect on the driving roller 56. The lottery tickets 44 are therefore located by the auxiliary roller 41 in a one-way manner so as to prevent the lottery tickets 44 from being taken away by an unauthorized person.

Figure 8:
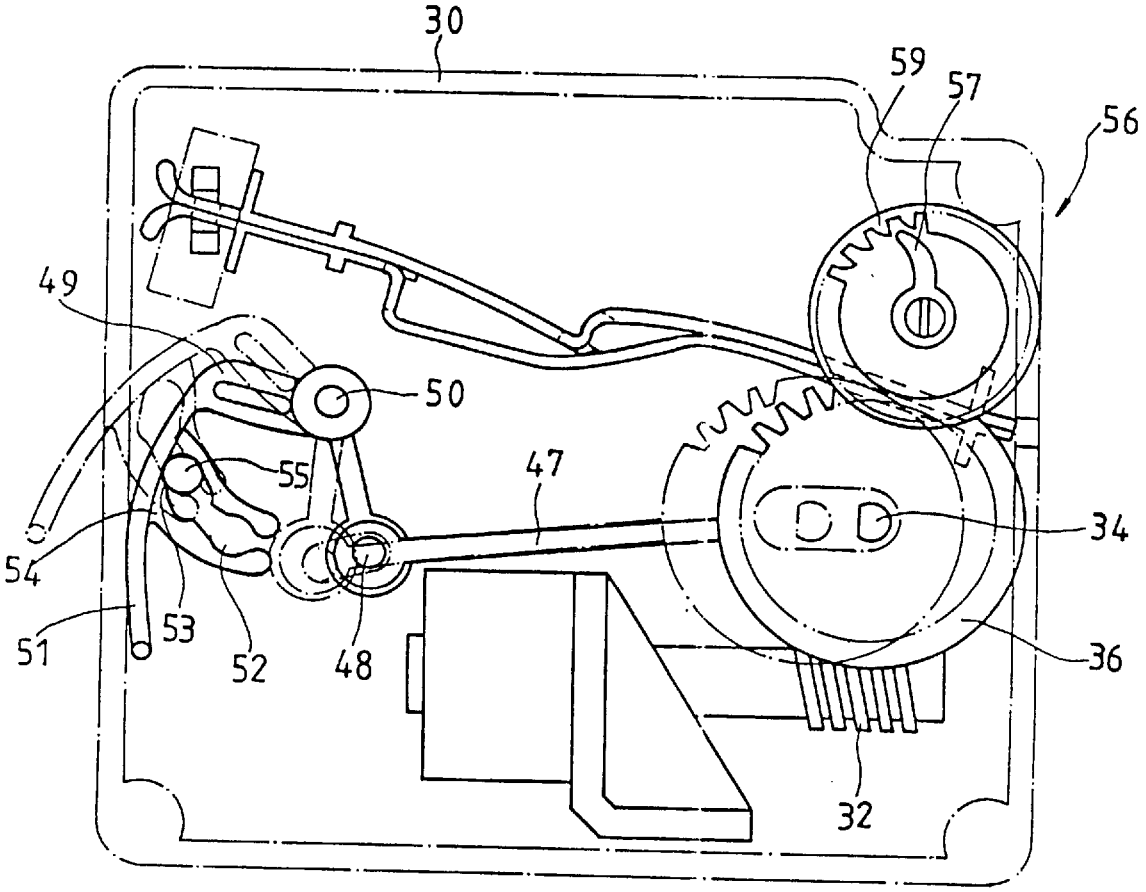
FIG. 8 shows a schematic view of the triggering element of the present invention at work.

Now referring to FIG. 8, the triggering element 49 of the present invention is fastened with the link rod 47 such that the driving roller 33 and the rotation gear 36 are actuated together. In a normal operation of the lottery ticket dispenser of the present invention, the rear locating edge 53 of the clamping member 54 of the triggering element 49 is located on the horizontal locating shaft 55 so as to cause the rotation gear 36 to engage the driven gear 58. In the meantime, the driving roller 33 is engaged with the auxiliary roller 41 while the worm rod 32 is engaged with the worm wheel 35. When the handle 51 of the triggering element 49 is moved upwardly to cause the front locating edge 52 of the clamping member 54 to locate on the locating shaft 55, the sliding shaft 48, the link rod 47 and the drive shaft 34 are pulled by the front end of the triggering element 49 to move rearward to cause the rotation gear 36 to disengage the driven element 56. In the meantime, the driving roller 33 and the auxiliary roller 41 are disengaged while the worm wheel 35 is no longer retained by the worm rod 32. As a result, the lottery ticket dispenser of the present invention can be serviced easily.

Figure 9:
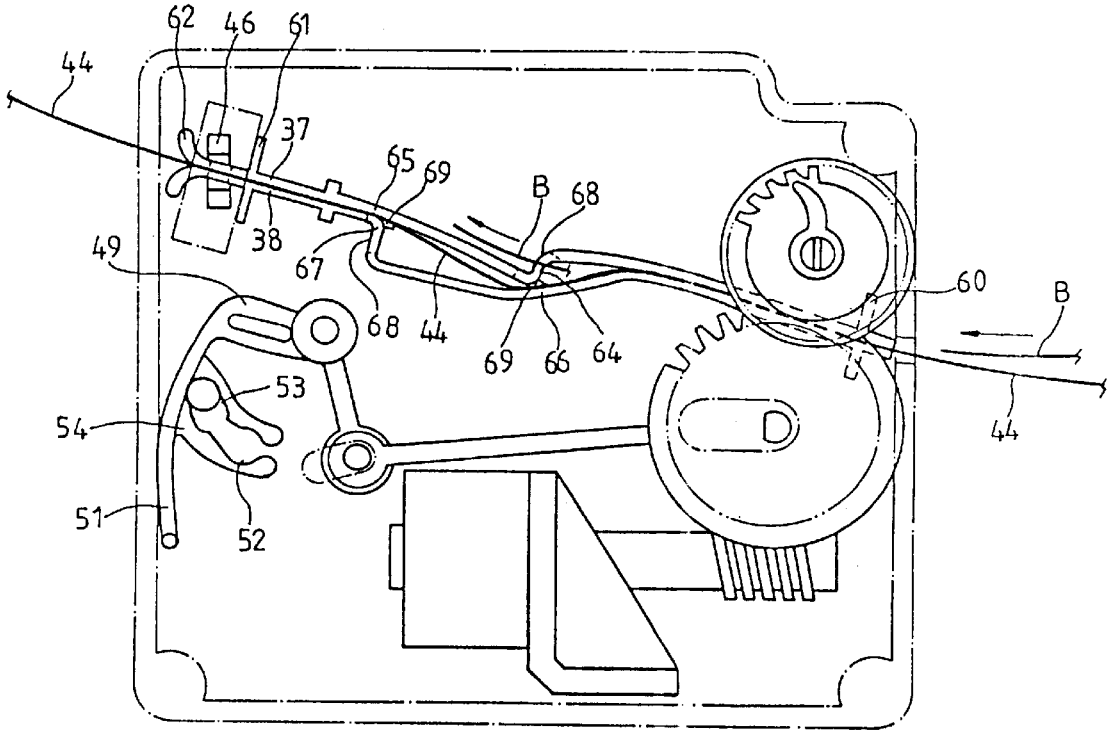
FIGS. 9A and 9B show schematic views of the present invention and show, in particular, how the present invention prevents tampering with the electronic eye.
Figure 9:
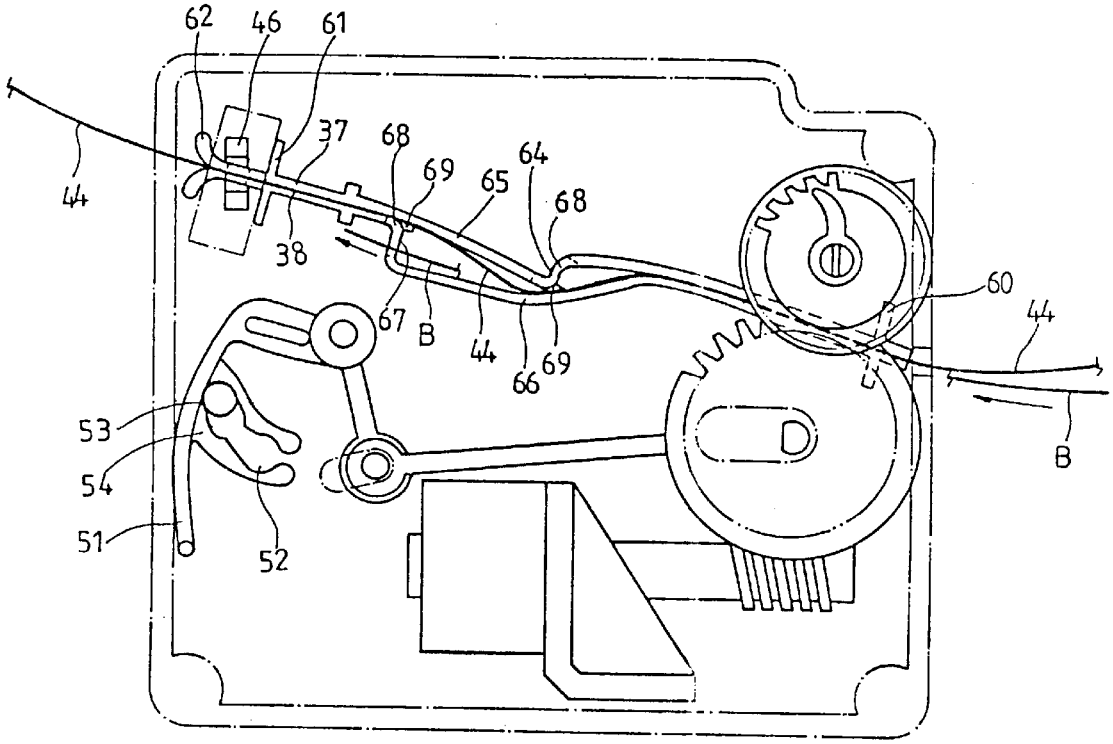

As illustrated in FIGS. 9A and 9B, the first stopping edge 60 of the upper guide plate 37 of the present invention serves to prevent the rigid thin piece B from being inserted at the opening 40 to force the driving roller 33 to move aside. In addition, the front and the rear baffles 64 and 67 of the upper and the lower guide plates 37 and 38 serve to prevent the rigid thin piece B from being inserted to obstruct the electronic eye 46. Moreover, the electronic eye 46 of the present invention is located on the opening 63 which is located between the second stopping edge 61 and the ticket guiding arcuate edge 62, thereby preventing the electronic eye 46 from being damaged or removed. The embodiment of the present invention described above is to be regarded in all respects as being illustrative and not restrictive. Accordingly, the present invention may be embodied in other specific forms without deviating from the spirit thereof. The present invention is therefore to be limited only by the scope of the following appended claim.

What is claimed is:

1. A burglarproof lottery ticket dispenser comprising:

main body;

a servomotor mounted longitudinally in said main body, said servomotor having a worm rod as an output shaft;

a drive shaft positioned in said main body, said drive shaft having a driving roller mounted thereon, said driving roller being provided with a worm wheel engageable with said worm rod, said drive shaft further having a rotation gear mounted thereon, said main body provided therein with an upper guide plate and a lower guide plate, an auxiliary roller means being mounted on a driven shaft such that said auxiliary roller means is in contact with said driving roller, said auxiliary roller means for dispensing a lottery ticket, said drive shaft of said driving roller fastened with a link rod and a slide rod fastened with a triggering element, said triggering element being mounted at a front end thereof on said slide rod, said triggering element having a handle means at a rear end thereof, said handle means for actuating said drive shaft, said driven shaft fastened with a driven element and a pawl, said driven element having a driven gear engageable with said rotation gear, said driven gear having a ratchet wheel capable of cooperating with said pawl, said upper and lower guide plates each being provided with a first stopping edge and a second stopping edge and a ticket guiding arcuate edge and an opening located between said ticket guiding arcuate edge and said second stopping edge, said opening having an electronic eye means mounted thereon, said electronic eye means for counting lottery tickets that have been dispensed, said upper guide plate provided at a midsegment thereof with a front baffle and a rear guide edge, said lower guide plate provided at a midsegment thereof with a front guide edge and a rear baffle.

* * * * *